United States Patent [19]

Patouillet

[11] 4,072,601

[45] Feb. 7, 1978

[54] PROCESS AND APPARATUS FOR PERFORMING ENDOTHERMIC CATALYTIC REACTIONS

[75] Inventor: Jean Joseph Nicolas Patouillet, Paris, France

[73] Assignee: Antar Petroles de l'Atlantique, Paris, France

[21] Appl. No.: 695,452

[22] Filed: June 14, 1976

[51] Int. Cl.[2] ..... C10G 35/04

[52] U.S. Cl. ..... 208/134

[58] Field of Search ..... 208/134

[56] References Cited

U.S. PATENT DOCUMENTS 3,785,953 1/1974 Patouillet ..... 208/49

*Primary Examiner*—C. Davis

*Attorney, Agent, or Firm*—Hammond & Littell

[57] ABSTRACT

A process for performing endothermic catalytic reactions, consists of introducing the reaction stream into at least one catalysis zone, constituted by at least one zone containing dilute catalyst and which can itself be preceded by a zone containing an inert catalyst-support, said dilute catalyst zone being followed by a conventional catalysis zone proper. Each of said zones is also separable from neighbouring zones by intercalated zones containing no material. Along said zones are heating means capable of providing variable amounts of heat to the reaction stream moving in each of said zones. Elongated catalysis zones are used including at the most two zones of dilute catalyst, arranged before the pure catalyst zone, if the direction of the reaction stream introduced is considered. The dilution is effected with a bulk material, different from the inert catalyst-support and a better heat conductor than it, which enables the temperature profile to be adapted along the reaction zone to the reaction speed in the latter.

14 Claims, No Drawings

PROCESS AND APPARATUS FOR PERFORMING ENDOTHERMIC CATALYTIC REACTIONS

BACKGROUND OF THE INVENTION

1. Field of the Invention

The present invention relates to an improved process and apparatus for performing endothermic catalytic reactions.

2. Description of the Prior Art

Applicant's U.S. application Ser. No. 738,831, filed June 21, 1968, now U.S. Pat. No. 3,785,953 relates generally to a process for performing endothermic catalytic reactions which consists basically of introducing the reaction stream into at least one catalysis zone, constituted by at least one zone containing a dilute catalyst and which can itself be preceded by a zone containing an inert catalyst-support, said dilute catalyst zone being followed by a conventional catalysis zone proper, each of said zones being also separable from adjacent zones by intercalated zones containing no material, and/or distributing along said zones, heating means capable of supplying variable amounts of heat to the reaction stream moving in each of said zones, the temperature within said stream being maintained substantially constant during its passage through said zones.

A process of this type is particularly advantageous in the catalytic reforming of petroleum fractions. According to an advantageous feature, the heating means are arranged outside the catalysis tubes, for example reforming furnace tubes, and they are constituted notably by radiant heating means whose heat flow can be directed on to several pipes. According to another preferred feature, the endothermicity of the reaction is controlled, thereby affecting at the same time the heating and the reactivity of the catalytic mass, the latter being adjusted by suitable dilution of the pure catalyst, adapted to the reaction capacity of the feedstock according to its degree of conversion.

It is thus possible to provide, between the inert inlet zone and the active outlet zone containing the 100% pure catalyst, successive catalyst zones whose ratio of dilution varies between 10 and 90%, with respect to the pure catalyst. For the dilution, provision is made for using preferably the inert catalyst-support, before its impregnation by the catalytically active chemical species.

By means of the process of the aforementioned patent, throughout a reactor comprising a group of catalysis tubes, a temperature profile is obtained related to that of an isotherm.

OBJECTS OF THE INVENTION

It is an object of the present invention to provide a process of the aforementioned type, in which it is possible notably to obtain temperature profiles which are variable along the reaction tubes and thus to adapt the temperature profile to the reaction speed in the zone concerned.

It is also an object of the invention to provide a process of the aforementioned type, which permits, in numerous cases, greater simplification of the arrangement of the catalysis tubes.

It is another object of the invention to provide a process of the aforementioned type, which permits greater flexibility of employment and, in particular, easy adaptation to feedstocks to be treated having very different chemical characteristics.

Another object of the invention is to provide a process of the aforementioned type, which permits the temperatures to be maintained at a practically constant value in a straight section of catalysis tube, or in other words, to lower the temperature gradients in the transverse direction of the reaction tubes to minimal values.

Another object of the invention is to provide an improved apparatus for carrying out a process of the above-mentioned type.

These and other objects of the invention will become apparent from the description which follows.

GENERAL DESCRIPTION OF THE INVENTION

The process according to the present invention is characterised in that elongated catalysis zones are used comprising at the most two zones of dilute catalyst, and preferably a single zone of dilute catalyst, arranged before the zone of pure catalyst, if the direction of the reaction stream introduced is considered, and in that the dilution is effected with a material in bulk, different from the inert catalyst-support and a better heat conductor than said inert support, which permits the temperature profile to be adapted, along the reaction zone, to the reaction speed in the latter. In the process of the invention, just as in that of the aforementioned patent, it is advantageous to precede the dilute catalyst zone, if this is a single zone, or the first dilute catalyst zone if there are two of them, by an inert zone constituted by the catalyst-support alone.

For effecting dilution, there is used, according to the invention, a material in bulk or a mixture of such materials, whose heat conductibility is higher than that of the inert support. It is possible, notably, to resort to pure or alloyed, homogeneous or sintered, metallic materials. Examples of such materials are aluminum, stainless steel and other metallic alloys such as alloys of aluminum and manganese.

In the sense of the present description, the expression "material in bulk" denotes a material occuring in the form of separate elements. The shape of these elements is not critical. It is possible, for example, to use just as well, materials constituted by cylindrical elements such as small rods, or such as generally spherical elements such as granules.

The size of the elements of the diluent must also be taken into consideration for obtaining the best results, that is to say a minimal temperature gradient in the straight section of the catalysis tubes. It is found for example that in the case of reforming petroleum fractions, dimensions of the order of 1.5 to 5 mm diameter and of 5 to 10 mm in length for cylindrical elements in the form of small rods, as well as 1.5 to 5 mm diameter for elements of generally spherical shape, prove to be suitable. These figures are only indicative in value and may be varied. The technician skilled in the art will be capable of determining the optimum values by theoretical studies of the heat transfers in the reaction tubes and by prior trails.

As has been noted previously, at the most two dilute catalyst zones are provided before the zone of pure catalyst. In the case where there are two zones of dilute catalyst, the highest values of the dilution close to the pure catalyst zone are used. For example, it is possible to provide a catalyst zone diluted to 10% and a catalyst zone diluted to 50% before the pure catalyst zone. In the case where a single zone of dilute catalyst is used, its dilution will be situated at average values comprised between 10 and 50%, for example at about 40%.

All the dilute and pure catalyst zones are advantageously preceded by a zone containing only the inert catalyst-support, for example, alumina.

It is observed that with the means proposed by the invention, the temperature gradients are diminished, transversely to the catalysis tubes, by more than half and even to three-quarters of the previously-obtained values.

Temperature measurements have been carried out within the catalytic bed in a straight section of tube in order to establish the influence of the nature of the diluent on the radial heat transfers. For this purpose, thermocouples were positioned at different places in the catalytic bed, on the one hand in a direction parallel to the direction of the heat flow emitted by the radiators passing through the centre of the tube, and on the other hand in a direction forming an angle of 120° with the preceding direction. Measurements have also been made at the centre of the tube. It is possible in this way, to trace the isotherm curves inside the catalytic bed and to determine at the same time the average temperature of the catalytic bed and the average temperature difference between the inner wall of the tube and the centre of the catalytic bed. It is thus possible to establish the influence of the nature, of the sizes and of the characteristics themselves of the diluent.

The results obtained with the diluents below were compared:

a. control test : dilution of the catalyst with porous alumina serving as a catalyst-support and having a thermal conductibility of 0.75 $Kcal/m^2/m/°$ C/h;

b. test according to the invention: dilution of the pure catalyst with small rods of sintered stainless steel having a thermal conductibility of 8 $Kcal/m^2/m/°$ C/h;

c. test according to the invention: dilution of the pure catalyst with small rods of aluminum and manganese alloy having a thermal conductibility of the order of 190 $Kcal/m^2/m/°$ C/h.

The average temperature difference between the inner wall of the tube and the centre of the tube for various reaction intensities in the case of catalytic reforming were recorded, the reaction intensity being evaluated according to the value of the octane number of the reformate. The results are grouped in the Table I below:

TABLE I

| | Average temperature difference inner wall - centre | |
|---|---|---|
| | Reaction intensity | |
| | ON* = 97/98 | ON* = 93/94 |
| Dilution with alumina | 46° C | |
| Dilution with sintered stainless steel | 43° C | 35° C |
| Dilution with Al-Mn alloy | | 21° C |

ON* = octane number

In a preferred embodiment, an apparatus for practising the process according to the invention comprises at least one catalysis tube, which includes, in the direction of the reaction stream, a zone containing the inert catalyst-support, at the maximum two zones of dilute catalyst, preferably a single zone of dilute catalyst, containing pure catalyst mixed with a material in bulk different from the inert catalyst-support and a better conductor of heat than the latter, and a zone of pure catalyst, at least certain of said zones being heated from the outside by radiators.

In the industrial field, a furnace equipped according to the invention can comprise several hundred tubes, such as have just been defined.

As a modification, empty zones can be provided between the previously defined zones or only between certain among them.

Thus, as has already been described in the aforementioned patent, automatic regulation systems available to the technician skilled in the art may be provided in order to regulate the addition of external heat from the radiators according to the requirements of the zone or of the zones of the catalysis tubes. Of course, it is advantageous, in practice, for a group of radiators to direct the heat flow on to several catalysis tubes.

It should be mentioned that in the prior art, catalytic processes are already known which employ inert materials conjointly with the catalytic system proper. Thus French Pat. No. 917,412 has proposed the association of an endothermic catalysis reaction with an exothermic reaction for regenerating the catalyst. The regeneration is effected by the combustion of the coke deposited on the catalyst, involving the equilibration of the two reactions so that it is possible to dispense with an addition of external heat.

French Pat. No. 917,412, therefore excludes external heating around the reaction zone since it provides only for effecting internal heating in the course of the cyclic operations of catalyst regeneration. Moreover, this known technique resorts to a chemically inert mass, which is capable of accumulating, then of restoring, the heat to ensure the successive reactions of catalysis and of regeneration. The nature, the shape and the arrangement of this inert mass, must therefore respond to particular conditions.

The method described in French Pat. No. 912,412 is not employed in catalysis tubes heated from the outside but in convertors, provided with plates or grids and having considerable volumes and transverse dimensions. In any case tubular reaction zones are not involved.

French Pat. No. 1,360,915 relates to the vapor phase oxidation of hydrocarbons, in the presence of a solid catalytic material. More particularly this patent relates to a method for manufacturing acrylonitrile using a catalyst bed including a particular distribution of inert material, which is designed to dilute the active catalyst proper. Such a method is applied to oxidation reactions, that is to say to exothermic reactions. This is a teaching which is opposite to that of the present invention.

The disposition of the catalyst in the system of French Pat. No. 1,360,915 is intended to retard the reaction by the incorporation of inert material in the active catalyst, without amounting however to blocking the activity of the latter. This dilution of the catalyst then permits, by limiting the extent of oxidation, a reduction in the release of heat in the course of the reaction which would risk inducing too high a rise in temperature liable to spoil the reaction.

None of this prior art teaches a process applicable to endothermic catalytic reactions in which the dilution mass is designed to reduce the thermal gradient due to the external heating of the catalysis tube. None of this prior art teaches a particular arrangement of the dilution zones with associated heating means in the zones concerned to adapt the temperature profile to the reaction speed in the reaction zone.

The process according to the invention finds a particularly advantageous application in the reforming of petroleum fractions. In fact, it offers for this purpose, important advantages with respect to conventional installations, whilst using the customary catalysts.

By means of the invention, it becomes possible to reduce by at least 20° to 30° C, the average operating temperatures. It is thus possible to reduce the expenditure of energy and catalyst fatigue, whilst increasing the yields of reformate, thereby reducing the risk of destruction of the latter under the effect of increases in temperature.

Another essential advantage of the invention is concomitally to permit an increase in the spatial velocity, that is to say the ratio of the weight of the feedstock to be processed with respect to the weight of the catalyst. It has, for example, been possible to obtain spatial velocity values of the order of 4.5 to 5, whilst, in the previously known technology, these values were situated rather, in industrial practice, between 1.5 and 2.5.

The fact that it is possible to increase spatial velocity thus enables the reduction of the amount of catalyst employed and the use of a smaller size installation.

It can also be emphasized that the invention offers a greater flexibility of operation and improved conditions of exploitation of the installation with respect to the prior art. It is possible, in fact, to effect variable temperature profiles, along the reactor, whilst having the possibility of processing feedstocks of very different chemical characteristics.

DESCRIPTION OF PREFERRED EMBODIMENTS

The invention will now be illustrated by the following examples which relate to the reforming of petroleum fractions, without these being considered as in any way limiting.

In all the tests reported below, the following apparatus, products and operational conditions were used:

Apparatus:

The reactor tubes were two in number and had a total length of 6.25 m, for a useful length of 5.50 m, and a diameter of 100 mm. The heating means were constituted by groups of radiant burners marketed by the Antargaz Company. In the direction of the length of the tubes, five groups of five burners were arranged successively, then two groups of four burners. The tubes were arranged in quincunx and the bundle of tubes was surrounded by five groups of five burners then by two groups of four burners on each side. In cross-section, there was therefore two parallel rows of burners occurring face to face and distributed around the bundle of tubes, each of the rows comprising five groups of five burners and two groups of four burners.

Feedstock

The feedstock was constituted by naphtha having a density of 0.745 to 15° C and whose content of naphthenes plus aromatic hydrocarbons × 2 was from 40 to 44.

Catalyst

The catalyst was based on platinum (0.35%) and iridium on a porous aluminum support. This is the catalyst marketed under the name RG 432 by French Petroleum Institute.

Operating pressure: 15 bars at the inlet of the tubes.

Temperature: variable according to the tests (see below).

EXAMPLE 1 (comparison)

A catalyst arrangement according to that described in the above-mentioned U.S. application Ser. No. 738,831, now U.S. Pat. No. 3,785,953 was chosen and providing good practical results. The successive zones, in the direction of the reaction stream, were as follows:

| | Length of zone (m) |
|---|---|
| Pure alumina | 0.75 |
| Catalyst diluted to 3.3% | 0.25 |
| Catalyst diluted to 6.5% | 0.25 |
| Catalyst diluted to 10% | 0.25 |
| Catalyst diluted to 25% | 0.25 |
| Catalyst diluted to 50% | 0.75 |
| Pure catalyst | 3 |

A spatial velocity equal to 2.5 was selected, the spatial velocity being defined as is well known, by the ratio by weight of the feedstock per hour to the total weight of catalyst.

The reforming conditions and the results obtained are assembled in Table II.

TABLE II

| Input temperature (kept constant) | 490° C | 510° C |
|---|---|---|
| Clear octane number (without the addition of tetraethyl lead) | 93.2 | 96.7 |
| Yield of reformate (by weight) | 89.3 | 79.6 |

EXAMPLE 2

In this example the method according to the present invention was practised by establishing a temperature profile variable along the bundle of tubes. The distribution of the zones of catalyst was as follows:

| | Length of zone (m) |
|---|---|
| Pure alumina | 0.75 |
| Catalyst diluted to 10% | 1.25 |
| Catalyst diluted to 50% | 0.50 |
| Pure catalyst | 3 |

The dilution of the catalyst was carried out in the proportion of 10% and of 50% in two successive zones. The diluent was constituted by small rods of sintered stainless steel of 3 mm diameter and 8 mm height.

In Table III below the operational conditions and the results corresponding to the various temperature profiles employed are grouped.

TABLE III

| Spatial velocity | 2.5 | 4.8 | 4.8 | 4.8 |
|---|---|---|---|---|
| Inlet Temperatures | 440° C | 456° C | 435° C | 458° C |
| at 1 m | 440 | 448 | 440 | 454 |
| at 2 m | 456 | 458 | 456 | 478 |
| at 3 m | 465 | 460 | 464 | 480 |
| at 4 m | 472 | 468 | 476 | 485 |
| at 5 m | 476 | 481 | 495 | 498 |
| outlet | 486 | 490 | 514 | 510 |
| Clear octane number | 98.4 | 93.5 | 96.3 | 96.9 |
| Yields (weight) of reformate | 80.2 | 83.2 | 82.8 | 82.9 |

It will be noted that the advances provided by the invention achieve improved results at equal spatial velocities (2.5) or even at distinctly higher spatial velocities, with distinctly lower operating temperatures and a simpler dilution of catalyst than in Example 1.

EXAMPLE 3

Results equivalent to those of Example 2 were obtained by using a single zone of catalyst diluted to 40% of 1.75 m length instead of the zones diluted respectively to 10% (1.25m) and to 50% (0.50m) of Example 2.

I claim:

1. In a process for reforming petroleum fractions by endothermic catalytic reactions, consisting of introducing the reaction stream into at least one elongated catalysis zone, constituted by at least one zone containing dilute catalyst and which can itself be preceded by a zone containing an inert catalyst-support, said dilute catalyst zone being followed by a conventional catalysis zone proper, each of said zones being also separable from neighbouring zones by intercalated zones containing no material, and of distributing along said zones heating means capable of providing variable amounts of heat to the reaction stream moving in each of said zones, the improvement consisting essentially of using at the most two zones of dilute catalyst arranged before the pure catalyst zone, if the direction of the reaction stream introduced is considered, and of carrying out the dilution of said dilute catalyst with a bulk material, different from said inert catalyst support and a better heat conductor than said inert catalyst support, which enables the temperature profile to be adapted along the reaction zone to the reaction speed in the latter.

2. The process of claim 1, wherein the catalysis zones comprise a single dilute catalysis zone.

3. The process of claim 1, wherein the first dilute catalyst zone is preceded by an inert zone constituted by the catalyst-support alone.

4. The process of claim 2, wherein the dilute catalyst zone is preceded by an inert zone constituted by the catalyst-support alone.

5. The process of claim 1, wherein said bulk material is a metallic material selected from among the group consisting of pure metals and homogeneous and sintered metallic alloys and their mixtures.

6. The process of claim 5, wherein said bulk material is selected from the group consisting of aluminum, stainless steel and alloys of aluminum and manganese.

7. The process of claim 1, wherein said bulk material is constituted by separate elements having the general shape of small cylindrical rods.

8. The process of claim 1, wherein said bulk material is constituted by separate elements having the general shape of spherical granules.

9. The process of claim 7, wherein said small cylindrical rods have about 1.5 to 5 mm diameter and 5 to 10 mm length.

10. The process of claim 8, in which said spherical granules have a diameter of about 1.5 to 5 mm.

11. The process of claim 1, wherein the dilution of said second dilute catalyst zone is greater than that of said first dilute catalyst zone.

12. The process of claim 11, wherein the dilution of the first zone is about equal to 10% and the dilution of the second zone is about equal to 50%.

13. The process of claim 2, wherein the single zone of dilute catalyst has an average dilution value comprised between about 10 and 50%.

14. The process of claim 13, wherein the single dilute catalyst zone has an average dilution value equal to about 40%.

* * * * *